United States Patent [19]

Horvath

[11] Patent Number: 4,850,586

[45] Date of Patent: Jul. 25, 1989

[54] EXERCISE APPARATUS

[76] Inventor: Juliu Horvath, 36 W. 74 St., Ap. 4C, New York, N.Y. 10023

[21] Appl. No.: 828,697

[22] Filed: Feb. 12, 1986

[51] Int. Cl.[4] ..... A63B 21/22

[52] U.S. Cl. ..... 272/72; 272/132; 272/134

[58] Field of Search ..... 272/116, 131, 132, 134, 272/145, 144, 146, 900, 130, 72, 67, 73

[56] References Cited

U.S. PATENT DOCUMENTS

| | | | |
|---|---|---|---|
| 502,467 | 8/1893 | Roessler | 272/72 |
| 881,521 | 3/1908 | Wilson . | |
| 1,727,657 | 9/1929 | Martin | 272/72 |
| 2,467,943 | 4/1949 | Mikell, Jr. | 272/80 |
| 2,760,774 | 8/1956 | Perez | 272/57 |
| 2,855,200 | 10/1958 | Blickman | 272/134 X |
| 3,120,954 | 2/1964 | Apostol | 272/134 X |
| 3,473,843 | 10/1969 | Hart | 272/144 X |
| 3,510,128 | 5/1970 | Richardson | 272/62 |
| 4,013,287 | 3/1977 | Dilkman | 272/136 |
| 4,229,001 | 10/1980 | Roman | 272/96 |
| 4,254,950 | 3/1981 | Baumann | 272/130 |
| 4,314,697 | 2/1982 | Brumfield et al. | 272/136 |
| 4,344,615 | 8/1982 | Carlson | 272/67 |
| 4,371,161 | 2/1983 | Williams | 272/96 |
| 4,402,502 | 9/1983 | Peters | 272/73 |
| 4,502,681 | 3/1985 | Blomqvist | 272/900 X |
| 4,621,623 | 11/1986 | Wang | 272/130 X |
| 4,629,185 | 12/1986 | Amann | 272/130 |

*Primary Examiner*—Richard J. Apley
*Assistant Examiner*—David J. Bender
*Attorney, Agent, or Firm*—Ostrolenk, Faber, Gerb & Soffen

[57] ABSTRACT

An integrated exercise device including an arm system and a leg system, wherein the arm system has rotors that can be oriented in any of three mutually perpendicular planes. The "arm system" can be used for exercising the legs as well as the arms. The leg system includes left and right wings that pivot vertically and are weighted for exercising the upper leg. The lower leg is exercised by spring-loaded sliding shafts that extend from the wings. A calf system includes spring arrangements for resisting an alternating motion of the toe and heel, and further for resisting a pumping motion of the foot.

6 Claims, 3 Drawing Sheets

EXERCISE APPARATUS

BACKGROUND OF THE INVENTION

1. Field of the Invention

The invention relates to exercise apparatus, and more particularly to an integrated exercise device including an arm system and a leg system, wherein the arm system has rotors that can be oriented in any of three mutually perpendicular planes for exercising the arms.

2. Background Art

Exercise devices of many types are known, including integrated exercise devices that provide different types of exercise for different parts of the body, such as those sold under the Universal and Nautilus trademarks. Such prior devices, however, have not taken an effectively integrated approach. The Universal machine system provides a single machine which is essentially an aggregation of several separate exercise devices, each part only performing one exercise operation on a single part of the body. An even less integrated approach is taken by the Nautilus system, in which a number of completely separate machines are provided, each machine, again, performing only limited functions.

Such prior art systems have the disadvantage that the user is required to move physically from station to station to exercise the entire body. In the Universal system the user must position himself adjacent different parts of the machine. In the Nautilus system the user must move to different locations in one or more rooms to use each separate machine.

Such systems have the further disadvantage of taking up excessive space, and they are also notoriously expensive.

SUMMARY OF THE INVENTION

Accordingly, one important object of the present invention is to provide an exercise device which is compact and may be manufactured inexpensively.

A further object is to provide apparatus in which each component performs a variety of exercise operations on more than one part of the body.

According to one aspect of the invention, there is provided an exercise apparatus comprising (a) frame means; and (b) an arm system including (i) rotor means for being rotated by a user to exercise the user's body; and (ii) support means on the frame means for adjustably supporting the rotor means in a selected plurality of positions with respect to the frame means, to provide a corresponding plurality of directions of rotation of the rotor means.

According to a further advantageous aspect, the apparatus comprises a leg system including wing means pivotally mounted on the frame means for receiving the user's lower leg and for being lifted thereby to exercise the upper leg.

According to another aspect, the leg system includes extension means on the wing means for receiving the user's toes and resisting extension thereof to exercise the lower leg.

According to a further aspect, the leg system includes means on the frame means for resisting an alternating motion of the toe and heel.

According to yet another aspect, the leg system includes means on the frame means for resisting a pumping motion of the leg.

In a preferred embodiment, the arm system has a left rotor and a right rotor which are rotated by radial handles fixed to the rotors for exercising either the arms or the legs, in a variety of positions. Although the arm system may also be used for the legs, it will be referred to hereinafter for convenience as the "arm system." The rotors are mounted on hinged and pivotal supports and can thereby be set up for rotation in any of three orientations, which will be referred to as: horizontal, vertical crosswise, and vertical lengthwise. The arm system can easily be changed between the three orientations without any disassembly.

Another aspect of the invention is means for generating forces to oppose rotation of the rotors. In a preferred embodiment, each rotor is mounted by a friction-free bearing on a base. The rotor also includes an annular front plate. A belt or the like is trained about the front plate and a capstan for the belt is mounted on the frame of the arm system. The arrangement of the belt and the capstan includes a braking device to generate forces to resist rotation of the rotor.

A leg system has left and right wings that pivot vertically above and below the plane of the bench for exercising the upper leg. Each wing has a shaft mounted on the wing for sliding in and out from a pivot point of the wing. The feet are held in pedals on the ends of the shafts by stirrups or the like. The shafts are spring-loaded to resist extension away from the pivot points for exercising the lower leg.

A further aspect of the leg system is a calf system including spring arrangements for resisting an alternating motion of the toe and heel, and further for resisting a pumping motion of the foot.

BRIEF DESCRIPTION OF THE DRAWINGS

Other objects, features, and advantages of the invention will be seen from the following detailed description of a preferred embodiment, in conjunction with the accompanying drawings, in which.

DETAILED DESCRIPTION OF A PREFERRED EMBODIMENT

Figure 1:
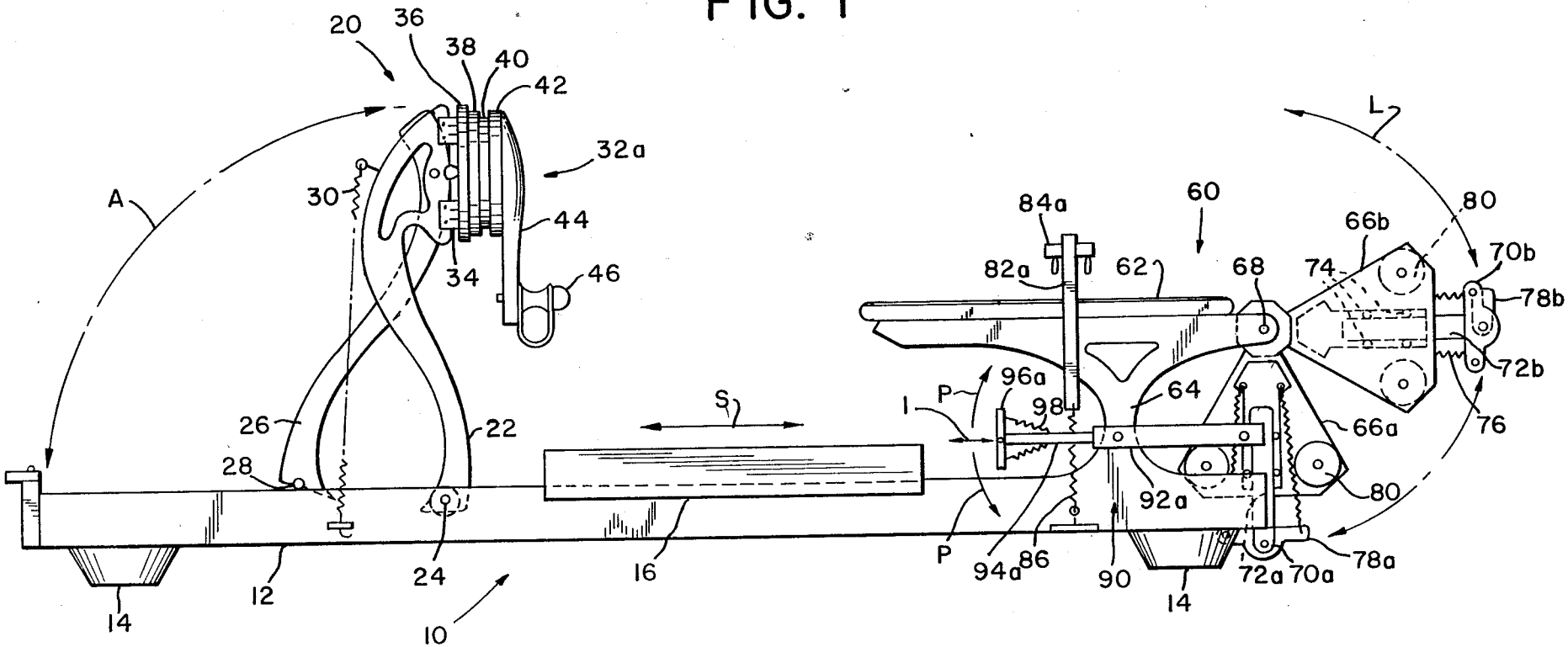
FIG. 1 is a side elevation of an exercise apparatus according to a preferred embodiment of the invention showing the arm system in its vertical crosswise position.

Referring to the FIGS., an exercise apparatus according to a preferred embodiment of the invention has a bench 10, including a pair of parallel rails 12 which rest on feet 14. A seat 16 is slidable toward the front and rear along the rails, as indicated by arrow S, as the user carries out various arm and leg exercises on the various parts of the apparatus.

An arm system, generally designated 20, includes a pair of struts 22 pivotally mounted on a crossbar 24 which extends between the rails 12. Thus mounted, the struts 22 can pivot approximately 90 degrees between the horizontal and the vertical in planes that are parallel to the rails 12, as indicated by the arrow A. The arm system is maintained in vertical position by a brace 26, which is pivotally connected to the struts 22 at their distal ends, i.e., the ends away from the crossbar 24, and can be pivoted into engagement with a second crossbar 28 extending between the rails 12 when the struts 22 are upright. The struts are restrained from pivoting more than about 90 degrees by a pair of springs, wires, or the like, designated 30, which are connected to the rails 12 and the distal ends of the struts 22.

Left and right rotors respectively designated 32*a* and 32*b* are mounted on the distal ends of the struts 22 by hinges 34. Thus hinged, the rotors 32*a*, 32*b* can be swung into a crosswise position, either vertically as seen in FIGS. 1–2, or horizontally as seen in FIGS. 3–4; or into a lengthwise position, as indicated by the arrows H in FIG. 2.

Figure 2:
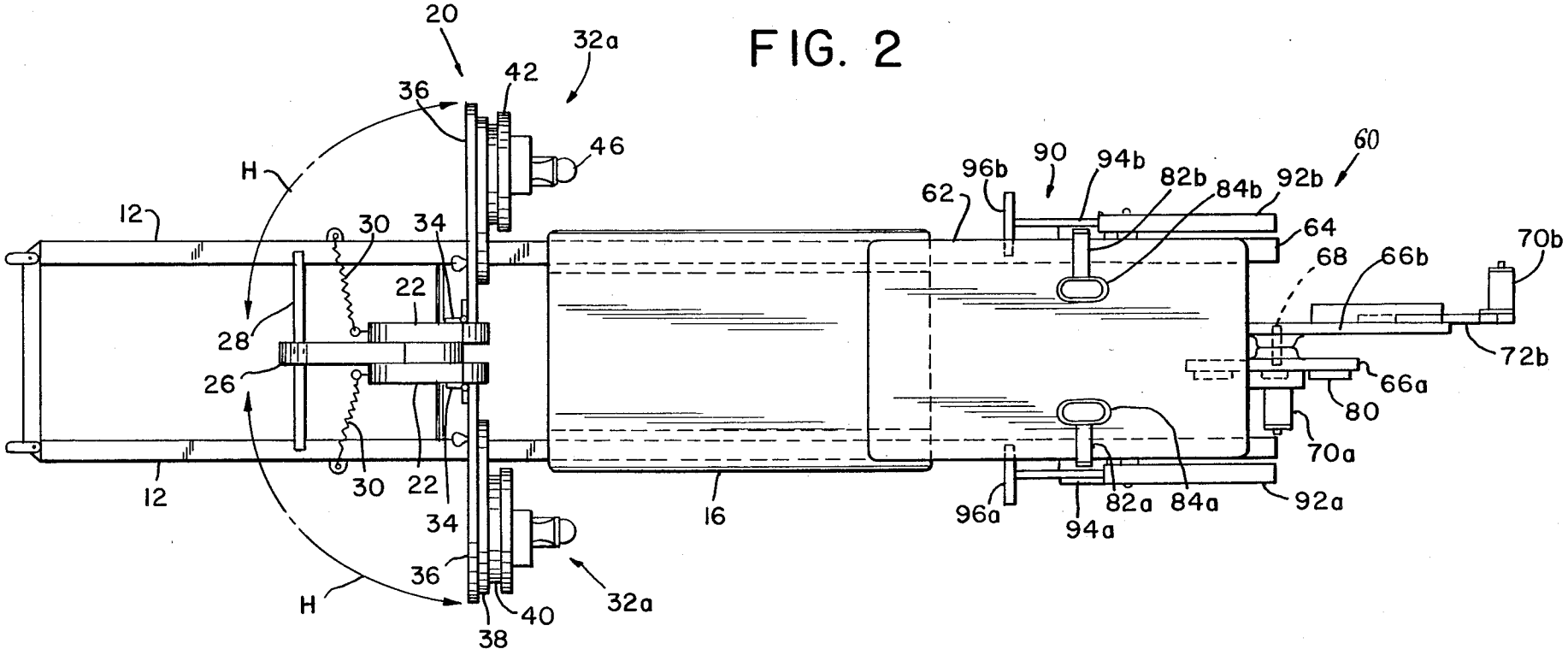
FIG. 2 is a plan view of the apparatus as in FIG. 1.
Figure 3:
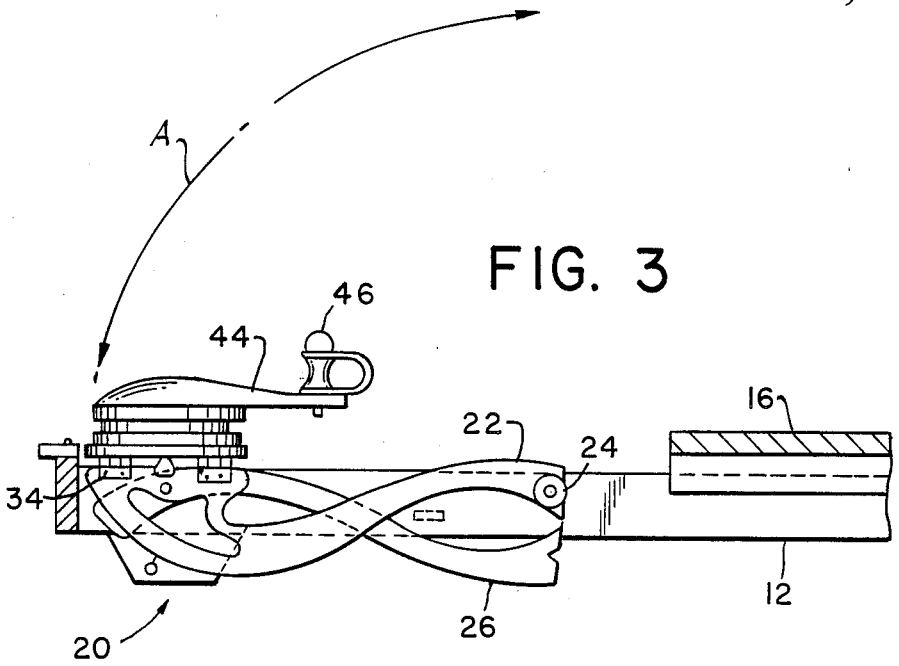
FIG. 3 is a partial elevational view showing the arm system in its horizontal position.
Figure 4:
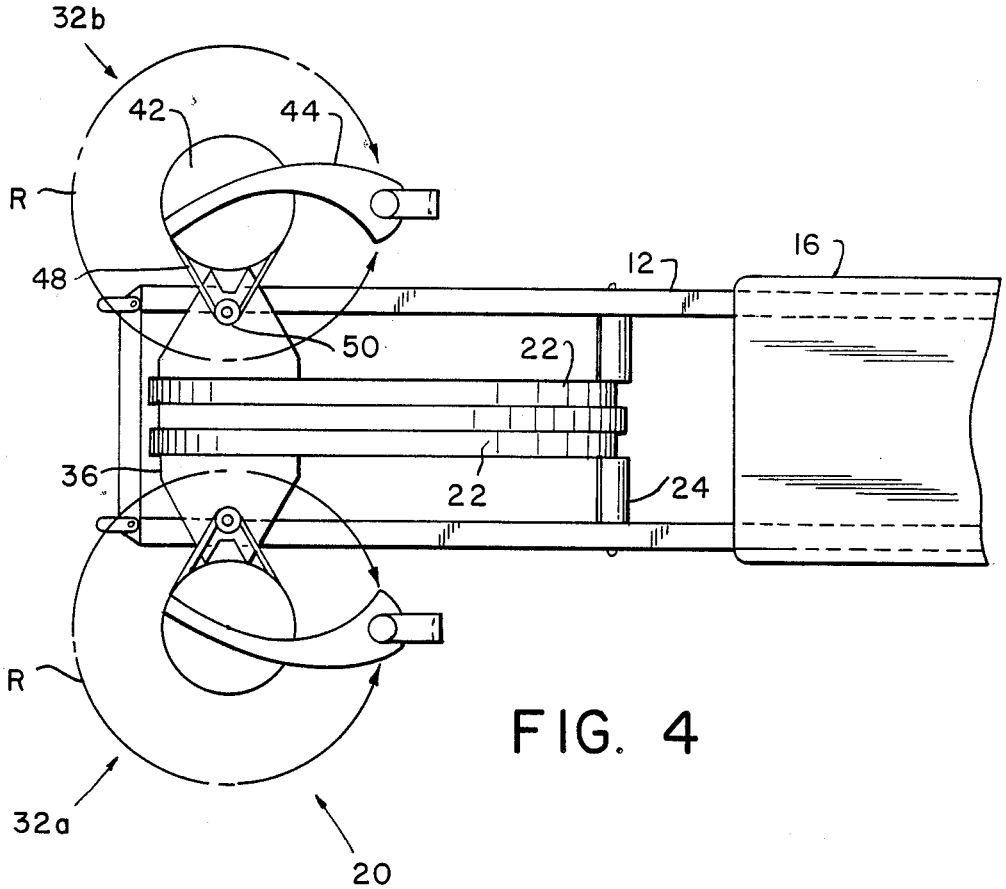
FIG. 4 is a partial plan view of the apparatus as in FIG. 3.

Thus, the arm system 20 can be oriented in two vertical positions—with the rotors in a crosswise orientation, as shown in FIGS. 1–2; or with the rotors lengthwise, as indicated by the arrows H in FIG. 2—and one horizontal position, with the rotors crosswise, as shown in FIGS. 3—4.

Each rotor includes a base 36 and a back plate 38 immovably mounted thereon and having an upstanding annular flange 40. A generally circular front plate 42 concentric with the flange 40 is rotatably mounted on the back plate 38, for circular rotation as indicated by the arrows R in FIG. 4. Each rotor further has a radial extension 44 with a perpendicular handle 46 at the end thereof away from the rotor.

The rotors 32 further include means for generating forces to resist rotation of the rotors and thereby exercise the limbs of a person using the apparatus. As seen in Fig. 4, such means may be a friction device consisting of a belt 48 which is trained around the front plate 42 and a capstan 50 on the base 36 having an associated braking device. Such a belt may be fixed to either the front plate or the capstan. Alternatively, a friction device may include a belt fixed to the handle 46 or the extension 44, and trained about the immovable flange 40 to generate a frictional force as the handle is rotated.

The arm system is used by setting it up in one of its three available orientations and then rotating the rotors. The user advantageously sits on the seat 16, and an elevated bench 62 is also available to be leaned against.

In any of the three positions, each rotor may be rotated either clockwise or counterclockwise. Although the term "arm system" has been used above, either the hands or the feet can be used to move the rotors, to exercise either the arms or the legs. Either an overhand or underhand grip of the arms may be employed.

Referring again to FIGS. 1–2, a leg system, generally designated 60, includes a bench 62 which is mounted on a frame 64. The frame 64 is fixedly mounted on the rails 12. Left and right wings 66*a* and 66*b* are pivotally mounted for rotation about an axis 68 on the rear end of the bench 62, i.e., the end away from the arm system 20. The wings can pivot in a vertical plane through about a 180-degree arc, as indicated by the arrows L in FIG. 1.

Slidably mounted on the wings 66*a*, 66*b* are respective extension shafts 72*a*, 72*b*. The shafts are supported on pins 74 or the like for movement toward and away from the pivot axis 68 against the force of springs 76. Pedals 70*a*, 70*b* are mounted at the outward ends of the shafts. The pedals have straps 78*a*, 78*b* for retaining the foot of the user. Also mounted on the wings are weights 80 for resisting upward lifting of the wings.

To use the wings 66 to exercise the legs, the user is located on the bench 62 in either prone or supine position. The feet are placed on the pedals 70 and retained thereon by the straps 78. Straps 82*a*, 82*b* and buckles 84a, 84*b*, which are attached to the rails 12 by springs 86 or the like, may be employed to hold the thighs of the user against the bench. The thigh muscles then may be exercised by lifting the wings, including the weights 80, upward and downward. The calf and foot muscles may be exercised by urging the pedals outward with the toes, against the force of the springs 76.

A further aspect of the leg system 60 is a calf system 90, which includes a pair of elongated housings 92*a*, 92*b* fixedly mounted on the frame 64, and corresponding shafts 94*a*, 94*b* accommodated in the front ends thereof. The shafts 94 may be fixed in the housing 92 or may alternatively be accommodated therein in a piston-like arrangement in which the shafts are moved into the housings against the force of a spring, as indicated by the arrow I in FIG. 1. In the latter arrangement, a latch pin or the like may be provided to selectively immobilize the shaft 94 to terminate such piston-like movement.

At the forward ends of the shafts 94 are a pair of pedals 96*a*, 96*b*. The pedals are pivotally mounted on the shafts for rotation of the upper and lower sides of the pedal toward the rear of the apparatus. A plurality of springs 98 are provided to resist such rotation.

The calf system 90 is used by sitting on the seat 16, facing rearward, and placing the feet on the pedals 96. The calf muscles are then exercised by alternately pushing the toes and heels rearward to rotate the pedals 96 against the force of the springs 98. The upper leg muscles may be exercised by pushing the pedals rearward against the compression force of springs in the housings 92. The seat 16 is moved forward or rearward to an appropriate position.

Although a preferred embodiment of the invention has been described herein, it is to be understood that the invention is not limited to such embodiment. Rather, variations and modifications may occur to one skilled in the art within the scope of the invention, as defined only by the appended claims.

What is claimed is:

1. An exercise apparatus for being moved by a user in a circular motion in a plurality of mutually distinct planes to exercise the user's body, comprising in combination:

a frame; the frame defining a horizontal direction, a longitudinal direction, a transverse direction, and a vertical direction;

a support pivotally mounted on the frame at a first end of said support, for being selectively pivotable into a vertical position and into a horizontal position and secured in such positions;

a pair of rotor bases pivotally mounted at a second end of said support, for being selectively pivotable and securable in a transverse position and a longitudinal position when said support is vertical, and in a transverse position when said support is horizontal; and a pair of handles, each mounted on one of said rotor bases, for being grippable and movable by the user through substantially 360 degrees in a circular motion to exercise the user's body.

2. Apparatus as in claim 1, further comprising a leg system including wing means pivotally mounted on the frame for receiving the user's lower leg and for being lifted thereby to exercise the upper leg.

3. Apparatus as in claim 2, wherein the leg system further includes extension means on the wing means for receiving the user's toes and resisting extension thereof to exercise the lower leg.

4. Apparatus as in claim 3, wherein the leg system further includes means on the frame for resisting an alternating motion of the toe and heel.

5. Apparatus as in claim 4, wherein the leg system further includes means on the frame means for resisting a pumping motion of the leg.

6. An exercise apparatus comprising (a) frame means; and seat means on the frame means;

(b) a rotor system including (i) a pair of rotor base means, and a corresponding pair of handle means mounted on the rotor base means which are rotatable thereon through substantially 360 degrees in a substantially continuous circular motion; and (ii) support means on the frame means for securably supporting the rotor base means in at least first and second predetermined positions with respect to the frame means, in which positions said handle means are rotatable by a user located adjacent the seat means to exercise the user's body, said handle means being rotatable by the user in first and second respective planes, through substantially 360 degrees in both said planes, when the rotor base means are in said first and second positions; and wherein the frame means defines a longitudinal direction and a transverse direction; and the left and right handles are rotatable at least in a plane that extends substantially perpendicular to said frame means; and wherein said perpendicular plane in which the handles are rotatable extends vertically and in said transverse direction of said frame means;

(c) means associated with said handles, for resisting rotation of said handles by user and thereby increasing the exercising of the user's body.

* * * * *